United States Patent [19]

Hepfer et al.

[11] Patent Number: 4,466,744

[45] Date of Patent: Aug. 21, 1984

[54] STRIKING CLOCK INCLUDING DEVICE FOR SELECTIVELY AND/OR TEMPORARILY PREVENTING THE GONG OR BELL FROM BEING STRUCK

[75] Inventors: Rolf Hepfer, Bad Dürrheim; Jürgen Rünzler, Spaichingen, both of Fed. Rep. of Germany

[73] Assignee: Joseph Kieninger GmbH & Co. KG, Fed. Rep. of Germany

[21] Appl. No.: 448,336

[22] Filed: Dec. 9, 1982

[30] Foreign Application Priority Data

Dec. 10, 1981 [DE] Fed. Rep. of Germany ..... 3148853

[51] Int. Cl.[3] ..... G04B 23/00

[52] U.S. Cl. ..... 368/262; 368/269

[58] Field of Search ..... 368/72–74, 368/75, 76, 243–244, 254, 262–263, 269–271, 272–273

[56] References Cited

U.S. PATENT DOCUMENTS

| | | | |
|---|---|---|---|
| 1,731,538 | 10/1929 | Mackenzie | 368/269 |
| 3,945,340 | 3/1976 | Yanagsawa | 368/269 |
| 4,036,005 | 7/1977 | Jauch | 368/269 |
| 4,208,867 | 6/1980 | Polonsky | 368/262 |
| 4,209,968 | 7/1980 | Remys et al. | 368/262 |
| 4,213,291 | 7/1980 | Wooding | 368/263 |

*Primary Examiner*—Vit W. Miska

*Attorney, Agent, or Firm*—McGlew and Tuttle

[57] ABSTRACT

To prevent a striking clock temporarily from striking, a device is provided comprising a sectorial detent disc which is driven by the clockwork to make a revolution once in 24 hours and is mounted in the swing range of an engaging lever. To eliminate the effect of the detect disc for any period of time, or restoring its function again manually, while avoiding an obstruction of the normal function of the striking mechanism, the engaging lever is secured to a shaft which is driven through a lever by the striking mechanism and carries or actuates one or more hammers. The engaging lever is manually arrestable for any time in a position for preventing the striking motion of the hammers and the detent disc can be displaced away from the swing range of the engaging lever. The detent disc may be designed with individual sectors which are displaceable or deflectable into and out of the swing range of the engaging lever, so that the time periods during which the striking is eliminated can be varied.

17 Claims, 15 Drawing Figures

STRIKING CLOCK INCLUDING DEVICE FOR SELECTIVELY AND/OR TEMPORARILY PREVENTING THE GONG OR BELL FROM BEING STRUCK

FIELD AND BACKGROUND OF THE INVENTION

The present invention relates in general to clock movements and in particular to a new and useful device for selectively and/or temporarily preventing the striking of a clock.

Striking clocks are known which have a gong or bell that can be struck by a hammer. Such striking clocks may include a sectorial detent disc that is provided on a gear which is driven by the clockwork and makes a complete revolution once in 24 hours. The circumference of the detent disc temporarily comes into the swing range of the striking mechanism, thereby preventing the gong or bell from being struck during a definite period of time corresponding to the circumferential extension of the detent disc.

In a commercial striking clock of this kind in which both the clockwork and the striking mechanism are weight-driven, the detent disc whose circumferential extension corresponds to a time period of about 10 hours, is mounted for rotation, but secured against axial displacement, on a pin. The disc is disposed into the swing range of a lever, which is firmly connected to the release lever and prevents the stroke release as long as this lever engages the circumferential edge of the disc. In addition, this lever is associated with a manually actuable latch with which the lever can be locked in its position for any period of time, independently of the respective angular stroke-preventing position of the detent disc.

In this prior striking clock, the effect of the detent disc cannot be suppressed at will. This means that the striking mechanism of such a clock is arrested for the period of time corresponding to the length of the circumferential edge of the detent disc.

SUMMARY OF THE INVENTION

The present invention is directed to a striking clock of the above-mentioned kind which is equipped with an improved device for selectively and/or temporarily preventing the gong or bell of the clock from being struck, in which the effect of the detent disc can manually be eliminated as desired and again restored to function, and in which, in contradistinction to the prior art, the striking mechanism can work normally even if the detent disc is effective and prevents strokes from making the gong or bell sound.

Accordingly, an object of the present invention is to provide a device for preventing striking of the clock having a striking mechanism including a manner shaft movable for a striking of the clock, comprising, an engaging lever co-rotationally connected to the hammer shaft and movable in a path during striking of the clock, a rotatably mounted detent disc having at least a portion in the path of said engaging lever for at least a selected duration, disc drive means connected to said disc for rotating said disc at a rate to establish said selected duration, and a manually displaceable member movable into a first position in the path of said engaging lever for preventing striking of the clock.

Aside from providing the known possibility of stopping the strokes for certain periods of time, such as during the night, by means of a manually operated member, the inventive device has the advantage that by axially displacing the detent disc, the effect of the disc is eliminated while the striking mechanism is allowed to work, even during the time in which the detent disc, in effective position, supresses the strokes.

If the detent disc is designed to have sectors that are displaceable in the axial direction, it is even possible to provide periods of time during which the clock does or does not strike as desired, i.e. to program the striking.

With the inventive design, the normal working of the striking mechanism again is not hindered if the detent disc is in its locking position and eliminates the strokes, because the disc only prevents the striking motion of the hammer or hammers, and does not produce any effect on the other parts of the striking mechanism. This results in the advantage that with a weight-driven clock, the weights of both the clockwork and the striking mechanism continue to lower uniformly as usual.

A further object of the invention is to provide a device for preventing the striking of a clock wherein at least a portion of the detent disc is movable axially to selectively enter and leave the path of said engaging lever, the clock including a back plate, a slide slidably mounted on said back plate including at least two bearing surfaces unequally spaced from said back plate, and at least two cams adjacent said bearing surfaces, an operating fork engaged with said detent disc and axially displaceable on said back plate, said operating fork engaged on said slide for axial movement across said bearing surfaces and cams with sliding movement of said slide for selectively moving said detent disc axially.

A still further object of the invention is to provide such a device wherein said slide is provided with an arresting finger engageable with said engaging lever, said slide with arresting finger forming said manually displaceable member. In this manner, both the actual displacement of the detent disc and the locking of the engaging lever can be effected by a single component.

The engaging lever is provided with an engaging pin which is movable into the axial direction of displacement of the detent disc and has an oblique engaging front face. This oblique face makes sure that the rotary motion of the detent disc remains unobstructed even in instances where, considered in the direction of rotation, the radially extending leading edge of the sectorial detent disc butts against the engaging pin.

Considered in the normal direction of rotation, the trailing end of a circumferential edge of the detent disc, which is engageable by the engaging lever, is followed by an obliquely radially inwardly extending edge portion. This radial edge serves the purpose of lifting the engaging pin and the engaging lever to the circumferential edge of the disc.

Another object of the invention is to provide such a device wherein the detent disc is subdivided into a plurality of sectors which are individually displaceable from a common plane into the path of movement of the engaging lever, or its engaging pin, with the sectors together forming a substantial continuous circumferential edge.

These sectors are associated, for example, each with a certain period of time, such as an hour, so that the striking mechanism can be programmed to strike during selected hours and execute only idle strokes, producing no sound, during the remaining hours.

A stiff further object of the invention is to provide such a device wherein the detent disc comprises a circular disc of a resilient material which is subdivided by radial separating cuts into the plurality of sectors which have mutually equal circumferential lengths.

Further, device may provide set screws associated with the detent disc for selectively axially moving each sector, the detent disc including a back-up disc having tap thruholes for receiving the set screws.

Another object of the invention is to provide a device which has a programmable detent disc which includes a backup disc co-rotationally connected to said detent disc, the detent disc being divided into a plurality of sectors, with a plurality of setting members slidably mounted to the back-up disc having a wedge-shaped cam-like projection engageable with each sector respectively whereby each sector can selectively be moved axially out of a common plane of the sectors by sliding movement of a respective setting member.

While dropping the advantage of being able to cancel a set striking program, the detent disc may be mounted without axial displaceability. Then, the strokes may still be released by returning all the sectors of the disc into their ineffective position outside the swing range of the engaging lever, however, the set striking program will thereby be erased and a new program must be set.

Another object of the invention is to provide a device, in a clock having a striking mechanism, for selectively preventing striking of the clock, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and decriptive matter in which preferred embodiments of the invention are illustrated.

BRIEF DESCRIPTION OF THE DRAWINGS

In the following, several embodiments of the invention are explained with reference to the drawings in which.

DESCRIPTION OF THE PREFERRED EMBODIMENTS

Figure 1:
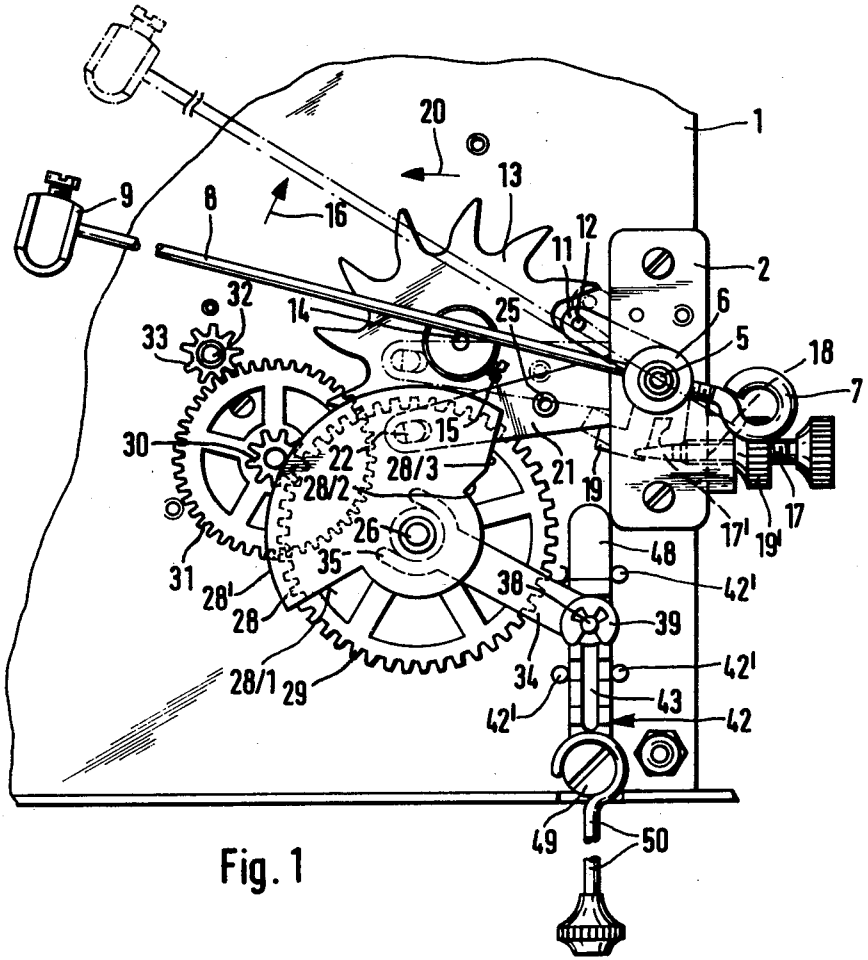
FIG. 1 is a partial rear elevational view of the inventive device mounted on the bottom or back plate of a clockwork.

Referring to the drawings in particular, the invention embodied therein, as shown in FIG. 1, comprises a device, in a clock having a striking mechanism, for preventing striking of the clock while permitting movement of most of the striking mechanism, which comprises a detent disc 28 having at least a sector removed and axially displaceable into the path of motion of an engaging lever 21 co-rotationally connected to a hammer shaft 5.

Only those component parts of a striking clock are shown in FIGS. 1 to 7, which are relevant to the explanation of the inventive device. In this example, the invention is applied to a striking clock having a half-hour striking mechanism. The inventive device, however, may be used in a striking clock of any kind.

The bottom or back plate 1 of a clockwork partly shown in FIGS. 1 to 7 is provided on its outside with a bridge plate 2 which is secured to plate 1 by means of two columns 3,4 of equal length and extends in spaced relationship therewith. Mounted for rotation on plate 2 is a hammer shaft 5 having its second bearing in the front plate (not shown) of the clockwork. The portion extending outside plates 2 of hammer shaft 5, carries a bushing 6 which can be secured against rotation on shaft 5 by means of an eye bolt 7 screwed radially therein. A rod-shaped hammer shaft 8 extends diametrically opposite eyebolt 7 and is press-fitted in a bore of bushing 6. Shaft 8 carries a hammer 9 on its free end. Between plate 2 and plate 1, a bushing 10 is non-rotatably press-fitted to hammer shaft 5 and carries a lifting wheel lever 11 non-rotatably riveted to one end of the bushing. Lever 11 carries on its free end a lifting pin 12 projecting toward plate 1 and into the path of motion of the teeth of a lifting wheel 13. Lifting wheel 13 is non-rotatably mounted on a shaft 14 and adjustable thereon in circumferential position by means of a clamping screw 15. Lifting wheel 13 is driven as usual by a striking mechanism (not shown) in a manner such that lever 11 is lifted by the teeth of wheel 13 a number of times corresponding to the number of strokes to be executed, whereby hammer shaft 5 is turned in the direction of arrow 16 and, as soon as lifting pin 12 drops into the next tooth space, turns back so that the lifted hammer falls to strike the gong or bell (not shown) and then is either lifted again or remain in its rest position shown in solid lines in FIG. 1, in which it is slightly spaced from the gong or bell. This spacing is adjustable by a set screw 17 which is screwed into an extension 18 of bridge plate 2 and a lock nut 19', with the front end 17' of screw 17 serving as a stop for a projection 19 of lifting wheel lever 11. The elements here described form parts of a conventional striking mechanism in which the lifting wheel 13 is turned at every full hour in the direction of arrow 20 through a number of teeth corresponding to the required number of strokes, with a single stroke, thus a single tooth step, being provided every half hour therebetween. Each tooth of lifting wheel 13, by passing pin 12, lifts the hammer through lever 11 and shaft 5 from its position shown in solid lines in FIG. 1 into the lifted position shown in broken lines in FIG. 1, or shown in solid lines in FIGS. 3 and 6, wherefrom the hammer can fall to strike the gong or bell and come into its rest position.

The following is a description of the device for permitting an elimination of the striking motion of hammer 9 or shaft 5 as desired, just for certain periods of time.

An engaging lever 21 is non-rotatably secured to bushing 10 which is fixed to shaft 5. On its free end, lever 21 is provided with an engaging pin 22. Pin 22 is guided in a slot-shape recess 23 of engaging lever 21, for being movable transversely to the plane of the engaging lever, and is secured to a leafspring 24 which resiliently applies against the side of lever 21 facing plate 1, and is fixed to lever 21 by means of a hollow rivet 25.

On a journal pin 26 firmly fitted in plate 1 below the swing range of engaging pin 22 of lever 21, a bushing 27 is mounted for axial displacement and rotation. A sectorial detent disc 28, in the embodiment of FIGS. 1 to 7, substantially in the shape of a semicircular segment, and a gear 29 are non-rotatably secured to bushing 27, with the arrangement being such that disc 28 can be brought into the path of motion of engaging pin 22 and lever 21. Through a pinion 30, and another gear 31, gear 29 is operatively connected to a pinion 33 carried on the minute shaft 32. The transmission ratio between pinion 33 and gear 29 is such as to obtain a full revolution of gear 29 and disc 28 in twenty-four hours. Consequently, the circumferential edge 28′ of disc 28, extending over almost a semicircle, corresponds to a time period of about ten hours during which hammer 9 may or may not be prevented from striking the gong or bell, depending on the axial position of detent disc 28. Along with disc 28, gear 29 meshing with pinion 30 is also axially displaceable. To permit this displacement, pinion 30 has a certain axial length. To be able to adjust disc 28 in a simple way to the correct time even after assemblage, a friction clutch is provided between minute shaft 32 and pinion 33. This clutch, however, might be provided between gear 29 and disc 28 as well.

Figure 2:
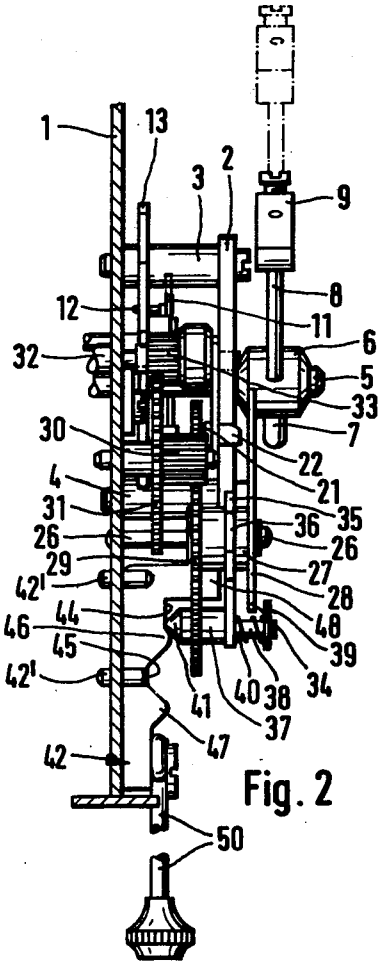
FIG. 2 is a side elevational view from the left, of the device of FIG. 1.

In FIGS. 1 and 2, the detent disc is shown in axial position in which it does not produce any effect on engaging lever 21 or engaging pin 22. In this ineffective position, disc 28 is located outside the swing range of engaging pin 22, so that hammer 9 is not prevented from executing its strokes. In FIGS. 3 to 7, on the contrary, disc 28 is in a position in which engaging pin 22, when dropping, falls on circumferential edge 28′ so that hammer 9, connected thereto through hammer shaft 5 and lever 21, is prevented from executing a full stroke as long as circumferential edge 28′ remains in the swing range of pin 22.

To be able to displace detent disc 28 along with gear 29 on journal pin 26 axially in one or the other of the two described positions, a fork lever 34 is provided. Fork lever 35 of lever 34 engages a circular groove 36 of bushing 27, and lever 34 is mounted by means of a bushing 37 for axial displacement on a pin 38 which is firmly fitted in plate 1. Fork lever 34 is urged toward plate 1 by a compression spring 40 which is carried on pin 38 and backed up by a ring 39. The end portion close to plate 1 of bushing 37 has the shape of a cone 41 applying against a slide 42 which is guided for vertical displacement in direct contact with plate 1, between four guides pins 42′. Intermediate its length, slide 42 is provided with an oblong slot 42 having a length determining the possible displacement of the slide, in which pin 38 of fork lever 34 is engaged. On its side remote from plate 1, slide 42 is provided with bearing surfaces 44, 45 which are unequally spaced from plate 1, i.e. are at unequal depths considered in the axial extension of pin 38 and bearing pin 26, with cams 46 and 47 being provided at either side of the deepest one 45 of the two bearing surfaces, which cams, in cooperation with the cone 41 of bushing 37, are capable of arresting slide 42 in three different dwell positions. In addition, on its upper end, slide 42 is provided with a locking finger 48 which, considered from plate 1, projects farther than bearing surfaces 44, 45, namely to the plane of engaging lever 21. To the lower end of slide 42, an actuating rod 50 is secured by a screw 49, serving as a stem for manually setting the slide 42.

The set position shown in FIGS. 1 and 2 is the lowermost position of slide 42, in which bushing 37 of fork lever is applied above cam 46 against bearing surface 44 which is remotest from plate 1, so that detent disc 28 is in a position outside the path of motion of engaging pin 22 of engaging lever 21, which is non-rotatably secured to hammer shaft 5. In this position, both detent disc 28 and engaging lever 21 are ineffective, so that the striking mechanism is not impeded in its complete operation. In the position shown in FIGS. 3 and 4, slide 42 is in its uppermost position in which engaging lever 21 applies from above against finger 48 of slide 42 and is lifted from detent disc 28. Cone 41 of bushing 37 is engaged below cam 47, thereby locking slide 42 in this position. With slide 42 set to this extent, hammer shaft and hammer 9 are prevented from executing the dropping stroke movements. Lifting wheel 13 of the striking mechanism, however, is not hindered in its normal rotary motion, which means that in itself, the striking mechanism works normally.

With this setting of slide 42, the axial position of detent disc 28 is irrelevant. In the shown embodiment, however, disc 28 is in the same position as with slide 42 set in accordance with FIGS. 1 and 2.

Figure 7:
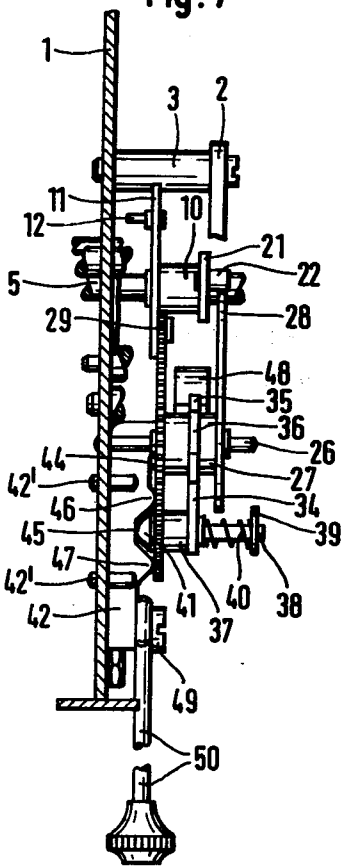
FIG. 7 is a left hand side view of the device as shown in FIG. 6.
Figure 6:
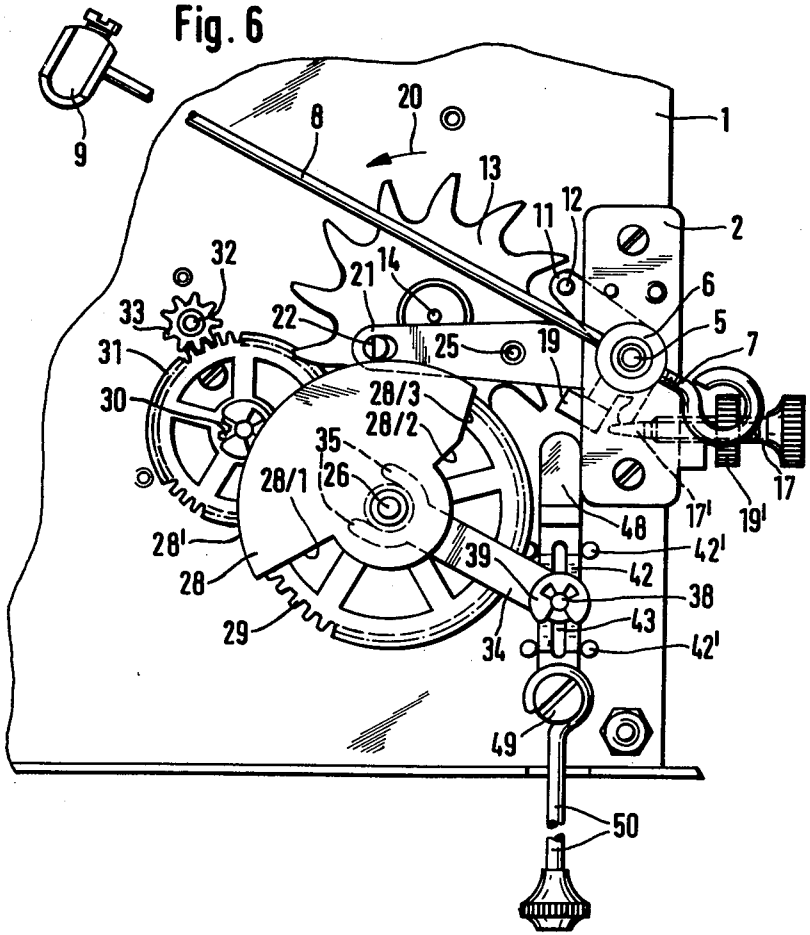
FIG. 6 corresponds to FIGS. 1 and 3 and shows the individual parts in another functional position.
Figure 8:
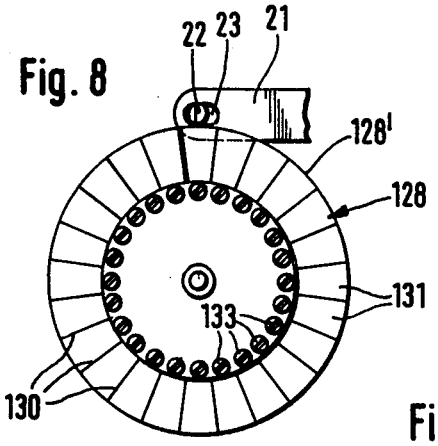
FIG. 8 is a front elevational view of another embodiment of the detent disc.

With the setting according to FIGS. 6 and 7, slide 42 is in its middle position in which cone 41 of bushing 37 engages the deepest bearing surface 45 extending between cams 46 and 47 and detent disc 28 is in a plane in which engaging pin 22 of engaging lever 21 performs its swing movements. If, with this axial position of disc 28, the circumferential edge 28′ thereof extends in the swing range of engaging pin 22, which depends on the time of the day, pin 22 drops, after every lift onto circumferential edge 28′, so that hammer 9 is prevented from completing its stroke, however, in this position again, the rotary motion of lifting wheel 13 is not hindered, since the lift caused by the teeth of wheel 13 of hammer shaft 5 with lever 11 and hammer 9, is not obstructed. Detent disc 28 only prevents the striking drop of hammer 9.

Figure 5:
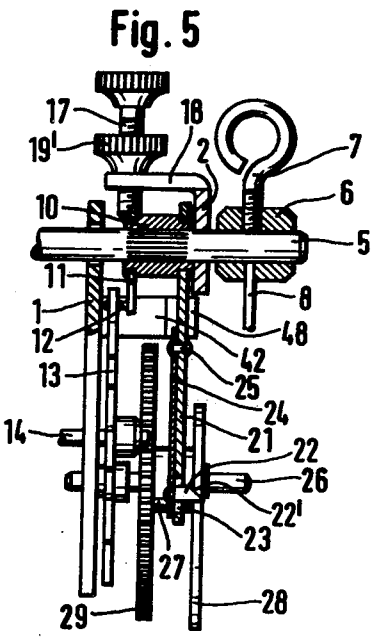
FIG. 5 is a partly sectional top view of the device as shown in FIG. 3.
Figure 4:
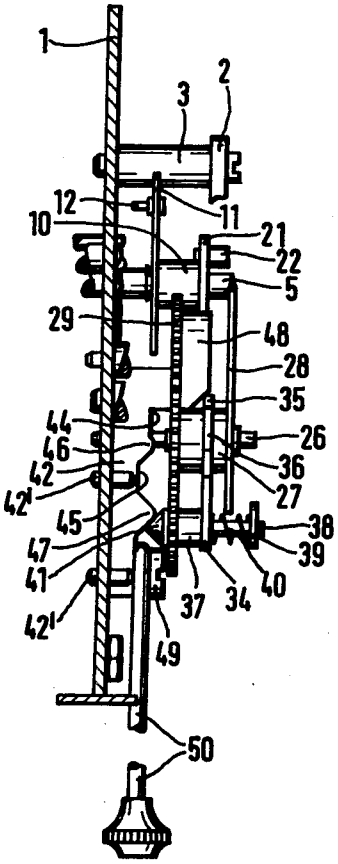
FIG. 4 is a left hand side view of the device as shown in FIG. 3.
Figure 3:
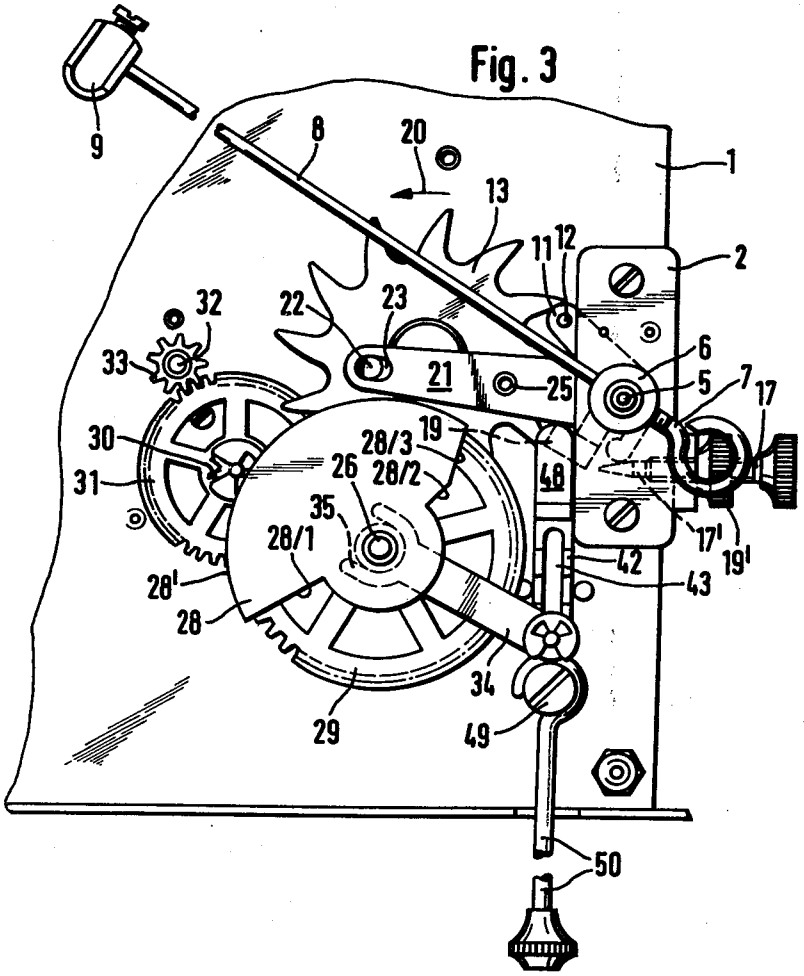
FIG. 3 corresponds to FIG. 1 and shown another functional position of the different parts.

The mentioned securing of engaging pin 22 to leaf spring 24 is intended to enable pin 22, when lever 21 is in its dropped position behind disc 28, shown in FIG. 1, to follow the axial displacement of disc 28 as soon as the disc is displaced from its ineffective position shown in FIGS. 1 and 2 into its operative locking position shown in FIGS. 5 and 6, or in FIGS. 3,4,5. In addition, engaging pin 22 has an oblique front face 22′ as best shown in FIG. 5, effecting axial displacement of pin 22 as soon as the leading radial edge 28/1 in the position shown in FIG. 1, butts against engaging lever 21. This prevents an unintentional arresting of the detent disc. The same purpose is served by an obliquely radially edge portion 28/3 provided on the trailing edge 28/2, becoming effective in instances where during a manual turning back of the clock hands, the detent disc 28 is taken along. As soon as during such a back turning, the oblique radial edge portion 28/3 butts against engaging pin 22, the pin is displaced by the edge in the clockwise direction as referred to the axis of hammer shaft 5, and lifted to the radial level of circumferential edge 28' of disc 28, so that disc 28 is prevented from being arrested in this instance too.

In consequence, three different positions can be set with the inventive device:

With slide 42 set in accordance with FIGS. 1 and 2, the device is ineffective, the clock strikes normally, every half and full hour.

With slide 42 set in accordance with FIGS. 3,4,5 hammer 9 is impeded in striking the gong or bell, while the striking mechanism operates normally. This position can be set for any period of time and can be reset at any time.

With slide 42 set in accordance with FIGS. 6 and 7, striking of the gong or bell is eliminated for about 10 hours, for example during the night, as long as circumferential edge 28' remains in the swing range of engaging pin 22. During the remaining time, such as the daytime, during which circumferential edge 28' moves outside the swing range of engaging pin 22, hammer 9 is free to strike the gong or bell. With this setting again, the normal work of the striking mechanism is never interrupted.

Figure 9:
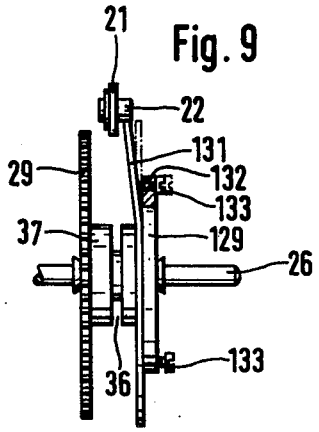
FIG. 9 is a side elevational view of the device of FIG. 8.
Figure 15:
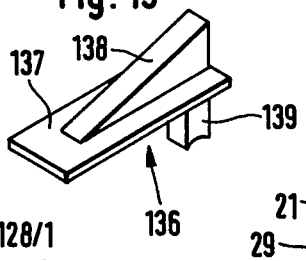
FIG. 15 is a perspective view of an individual part of FIGS. 11 to 14.
Figure 10:
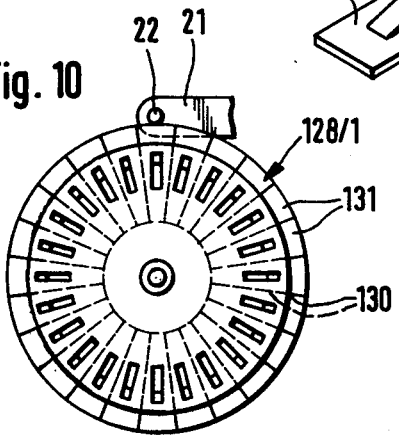
FIG. 10 is a front elevational view of still another embodiment of the detent disc.

While with the described detent 28 having an unchangeable circumferential edge 28' it is possible to eliminate the striking of the gong or bell only for a single period of time corresponding to the length of the circumferential edge 20, FIGS. 8 and 9, and 10 to 14 show modifications of the disc design permitting the setting of different periods of time during which the strokes can be eliminated. In these embodiments, the detent disc 128 is designed as a complete circular disc. It is made of a resilient flat material, such as sheet steel, and non-rotatably secured to bushing 27 along with a back-up plate 129 at the outside. By means of radial separating cuts 130 without gaps, detent disc 128 is subdivided into 24 sectors 131 of equal size which can individually be displaced or deflected to a definite extent in the axial direction of the disc. Each cut 130 extends from the circumferential edge 128' to the outer circumference of bushing 27. Back-up plate 129, which also is non-rotatably secured to bushing 27 and has a diameter of ⅔ that of disc 128, is provided along its circumference with a total of 24 tapholes 132 which are angularly equidistantly spaced from each other and located at the same radial level while being centrally associated with the respective sectors 131 of disc 128. As shown in FIG. 9, set screws 123 are engaged in tapholes 132. By means of the screws, the individual sectors 131 can be deflected from their normal position indicated in broken lines into an oblique position in which they reach into the swing range of engaging pin 22 of engaging lever 21. In their usual position, i.e. as long as they apply against the inside of back-up plate 129, sectors 139 are outside the swing range of pin 22 so that they cannot interfere with the motion thereof.

Figure 11:
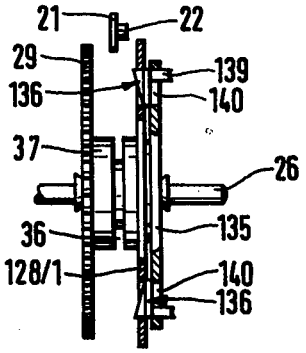
FIG. 11 is a left hand side view of the device of FIG. 10.
Figure 12:
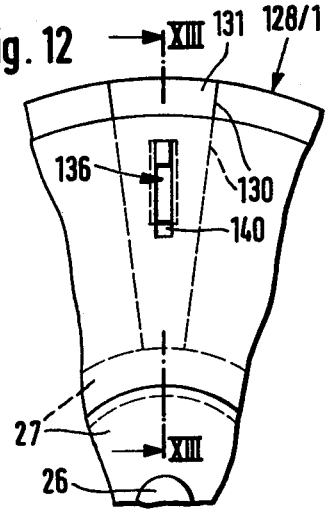
FIG. 12 is an enlarged detail of FIG. 10.
Figure 13:
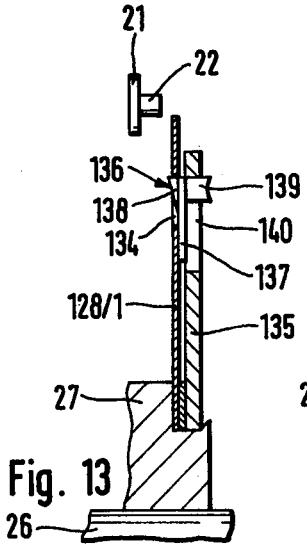
FIG. 13 is a sectional view taken through FIG. 12.

In the embodiment of FIGS. 10 to 14, the sectors 131 of detent disc 128/1 are provided with radial slots 134. The displacing mechanism also differs from the other embodiment, and comprises a back-up plate 135 and a total of 24 setting slides 136. Each setting slide 136 comprises a flat portion 137 which is provided with a wedge-shaped rib 138 on one side, and with a control pin 139 on the opposite side. Back-up plate 135 is provided with a total of 24 regularly distributed radial slots 140 extending along the same radius as the associated slots 134 of the individual sectors 131 of disc 128/1. The individual setting slides 146 are disposed between back-up plate 135 and and detent disc 128/1 in such position that the control pin 139 projects through a radial slot 140 to the outside and is displaceably guided in the slot. The radial slots 134 having about the same length as ribs 138 of slides 136, serve the purpose of receiving the respective rib 138 as long as radially setting slide 136 is in its uppermost position, as shown in FIGS. 11 and 13. In this position of setting slides 136, sectors 131 of disc 128/1 can occupy their normal position, as shown in solid lines in FIGS. 11 and 13, and in broken lines in FIG. 14. In this normal position, sectors 131 are outside the swing range of engaging pin 22 and do not interfere with the movements thereof.

Figure 14:
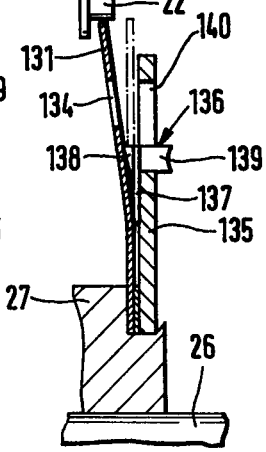
FIG. 14 is a sectional view similar to FIG. 13 with the disc sector in another position.

By radially displacing the setting slide 136 from its radially outer position shown in FIGS. 11 and 13 into its radially inner position as shown in FIG. 14, the associated sector 131 of disc 128/1 is deflected into an inclined position in which its circumferential edge comes to reach into the swing range of engaging pin 22 of lever 21. Since detent discs 128 and 128/1 as well as detent disc 28, are non-rotatably connected to gear 29, and thus also driven in time by the clockwork, each sector 131 remains for one hour within the angular zone of engaging pin 22 and can eliminate one half hour stroke and one hour stroke of the striking mechanism, depending on the setting of the set screws 133 or setting slides 136.

This design of setting discs 128 or 128/1 makes it possible to program the striking mechanism by hours, with the program once set being repeated everyday. There is even an option to employ a striking clock as an alarm clock, if one of detent discs 28 or 128/1 is used instead of detent disc 28. In such an arrangement again, detent discs 128 or 128/1 may be mounted for axial displacement on journal pin 26 in the same manner and with the same means as detent disc 28, to be able to make the set program ineffective. Since the individual sectors 131, particularly in the embodiment of FIGS. 10 to 15, are settable in a simple way, it may be provided to omit the mechanism for axially displacing discs 128 or 128/1.

To facilitate the programming of detent discs 128, 128/1 it is advisable to provide the individual sectors 131 with numerals 124 which then indicate the individual hours of the day.

While specific embodiments of the invention have been shown and described in detail to illustrate the application of the principles of the invention, it will be understood that the invention may be embodied otherwise without departing from such principles.

What is claimed is:

1. A device for preventing the striking of a clock having a striking mechanism including a hammer shaft movable for striking of the clock comprising:

an engaging lever co-rotationally connected to the hammer shaft and movable in a path during striking of the clock;

a rotatably mounted detent disc having at least a portion in the path of said engaging lever for at least a selected duration to prevent striking of the clock;

disc drive means connected to said disc for rotating said disc at a rate to establish said selected duration; and a manually displaceable member movable into a first position in the path of said engaging lever for preventing striking of the clock at all times.

2. A device according to claim 1, wherein at least a portion of said rotatably mounted detent disc is axially movable into the path of said engaging lever.

3. A device according to claim 2, wherein the clock includes a back plate, said device including a slide mounted for displacement to said back plate and provided on a side remote from said back plate with at least two bearing surfaces unequally spaced from said back plate, an operating fork engaged with said detent disc and axially movable with respect to said back plate for axially moving said detent disc, said operating fork having a portion engaged with said bearing surfaces of said slide, said slide movable to selectively engage one of said bearing surfaces with said operating fork, and, with said operating fork engaged with a first of said surfaces, said detent disc moved out of the path of said engaging lever and, with said operating fork engaged with the second of said surfaces, at least a portion of said detent disc moved into the path of said engaging lever.

4. A device according to claim 3, wherein said slide includes at least two cam surfaces adjacent said at least two bearing surfaces over which at least a portion of said operating fork is movable with sliding movement of said slide, a fork pin connected to said back plate, a fork bushing slidably mounted on said fork pin, said operating fork connected to said fork bushing, said detent disc having a disc bushing on which said operating fork is engaged for axially moving said detent disc with axial movement of said operating fork, and biasing means connected to said fork pin and engaged with said operating fork to urge said operating fork against said slide.

5. A device according to claim 3, wherein said slide includes an arresting finger engageable with said engaging lever in a first position of said slide, said slide forming said manually displaceable member.

6. A device according to claim 4, wherein said slide includes an arresting finger engageable with said engaging lever in a first position of said slide, said slide corresponding to said manually displaceable member and lockable in said first position when said operating fork is engaged with one of said cams.

7. A device according to claim 2, wherein said engaging lever includes an engaging pin movable axially in the axial direction of movement of said at least one part of said detent disc, said engaging pin having at oblique engaging face and being engageable with said detent disc for preventing striking of the clock.

8. A device according to claim 7, wherein said detent disc has a sector engageable with said engaging pin for preventing striking of the clock, said sector including a radial edge having an obliquely extending edge portion engageable with said oblique engaging face of said engaging pin for moving said engaging pin axially.

9. A device according to claim 2, wherein said detent disc includes a sector engaged with said engaging lever for preventing striking of the clock, said sector having a circumferential edge engaged with said engaging lever with a trailing end and an obliquely inwardly extending edge portion at said trailing end.

10. A device according to claim 2, wherein said detent disc comprises a plurality of individually displaceable sectors displaceable out of a common plane of said detent disc into the path of movement of said engaging lever and means for selectively holding at least one of said sectors in said path of said engaging lever.

11. A device according to claim 10, including an engaging pin connected to said engaging lever for engaging each of said sectors which are moved out of said common plane.

12. A device according to claim 11, wherein each of said sectors displaced out of said common plane form a substantially continuous circumferential edge engageable with said engaging end.

13. A device according to claim 10, wherein said detent disc is made of resilient material and each of said sectors has a substantially equal circumferential length, said detent disc being circular.

14. A device according to claim 10, including a back-up disc co-rotationally connected to said detent disc, a plurality of said screws threaded into said back-up and selectively engageable with respected sectors for selectively moving each sector into the path of said engaging lever.

15. A device according to claim 10, including a back-up disc co-rotationally connected to said detent disc, a plurality of setting members slidably engaged with said back-up disc having a cam projection selectively engageable with each sector respectively for selectively moving each sector into the path of movement of said engaging lever.

16. A device according to claim 15, wherein said back-up disc includes a plurality of slots corresponding in number to said plurality of setting members, each setting member slidable in a respected slot, each cam like projection of each setting member comprising a wedge engageable with a respective sector.

17. A method of preventing the striking of a clock having a striking mechanism including a hammer shaft movable to effect striking of the clock, an engaging lever co-rotationally connected to the hammer shaft and movable in a path, a rotatably mounted detent disc having at least a portion in the path of the engaging lever for a selected duration to prevent striking of the clock, drive means connected to the disc for rotating the disc at a rate to establish the selected duration and means for moving said detent disc axially out of the path of movement of the engaging lever, comprising:

positioning a manually movable slide into a first position crossing the path of the engaging lever for manually preventing striking of the clock;

engaging the slide with the detent disc for movement of the detent disc axially into the path of movement of the engaging lever in a second position of said slide; and moving the slide into a third position for disengaging the slide from the engaging lever and moving the detent disc out of the path of movement of the engaging lever.

* * * * *